US009146523B2

(12) United States Patent
Kabata et al.

(10) Patent No.: US 9,146,523 B2
(45) Date of Patent: Sep. 29, 2015

(54) CLEANER AND IMAGE FORMING APPARATUS

(71) Applicants: Toshiyuki Kabata, Kanagawa (JP); Momoko Shionoiri, Kanagawa (JP)

(72) Inventors: Toshiyuki Kabata, Kanagawa (JP); Momoko Shionoiri, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/043,946

(22) Filed: Oct. 2, 2013

(65) Prior Publication Data

US 2014/0119799 A1 May 1, 2014

(30) Foreign Application Priority Data

Oct. 26, 2012 (JP) ..... 2012-236689

(51) Int. Cl.
*G03G 21/00* (2006.01)

(52) U.S. Cl.
CPC ..... *G03G 21/0017* (2013.01)

(58) Field of Classification Search
USPC ..... 399/348, 350
See application file for complete search history.

(56) References Cited

U.S. PATENT DOCUMENTS

| | | | | |
|---|---|---|---|---|
| 2010/0183972 | A1* | 7/2010 | Hasegawa et al. | 430/119.7 |
| 2011/0135361 | A1* | 6/2011 | Kabata et al. | 399/350 |
| 2013/0243507 | A1* | 9/2013 | Sakon et al. | 399/350 |

FOREIGN PATENT DOCUMENTS

| | | |
|---|---|---|
| JP | 9-127846 | 5/1997 |
| JP | 2000-66555 | 3/2000 |
| JP | 2004-233818 | 8/2004 |
| JP | 2005-015753 | 1/2005 |
| JP | 2005-107376 | 4/2005 |
| JP | 2010-152295 | 7/2010 |
| JP | 2012-047961 | 3/2012 |
| JP | 2012-058528 | 3/2012 |

* cited by examiner

*Primary Examiner* — David Gray
*Assistant Examiner* — Michael Harrison
(74) *Attorney, Agent, or Firm* — Cooper & Dunham LLP

(57) ABSTRACT

A cleaner includes a rectangle elastic blade contacting a surface-moving object in a counter direction to remove an extraneous matter adhering to the surface of the object. An apical surface of the elastic blade in a longitudinal direction comprises a fluorine atom in an amount not less than 16.3% by atom when measured by X-ray photoelectron spectroscopy.

6 Claims, 5 Drawing Sheets

PERIPHERAL LENGTH: C1
PARTICLE PROJECTED AREA: S

CIRCLE HAVING AN AREA S
PERIPHERAL LENGTH: C2

CLEANER AND IMAGE FORMING APPARATUS

CROSS-REFERENCE TO RELATED APPLICATIONS

This patent application is based on and claims priority pursuant to 35 U.S.C. §119 to Japanese Patent Application No. 2012-236689, filed on Oct. 26, 2012, in the Japan Patent Office, the entire disclosure of which is hereby incorporated by reference herein.

BACKGROUND

1. Technical Field

The present invention relates to a cleaner used in image forming apparatuses such as printers, facsimiles and copiers, and to an image forming apparatus using the cleaner.

2. Description of the Related Art

Conventionally, in electrophotographic image forming apparatuses, residual a toner remaining on the surface of a photoreceptor even after a toner image thereon is transferred onto a recording material or an intermediate transfer medium is removed therefrom using a cleaner.

A cleaner installed in an image forming apparatus disclosed in Japanese published unexamined application No. JP-2000-66555-A includes a rectangle elastic blade, and a base end of the elastic blade is supported by a supporting member and an edge of the other end is contacted to the surface of an image bearer to block and scrape off a residual toner on the image bearer. Thereby, the residual toner is removed from the surface of the image bearer.

In attempting to meet a recent need of forming high quality images, a spherical toner prepared by a method such as polymerization methods (hereinafter referred to as polymerization toner) having a small particle is used. Since such polymerization toner has such an advantage as to have higher transfer efficiency than pulverization toner, the polymerization toner can meet the need.

However, the polymerization toner has such a drawback as not to be easily removed from an image bearer by a cleaning blade. This is because the polymerization toner has a spherical form and a small particle diameter, and easily passes through a small gap between the edge of a cleaning blade and the surface of the image bearer.

In attempting to prevent the polymerization toner from passing through a gap between the cleaning blade and the image bearer, it is necessary to increase the pressure to the cleaning blade contacted with the surface of the image bearer to enhance the cleanability of the cleaning blade.

However, when the contact pressure of the cleaning blade is increased, the friction between the cleaning blade and the image bearer is increased, and the tip of the cleaning blade is pulled by the image bearer in a moving direction thereof. Specifically, as illustrated in FIG. 7A, a cleaning blade 262 is pulled by the surface of an image bearer 23 in a moving direction of the image bearer due to increase of friction between the blade and the image bearer, thereby causing a problem (hereinafter referred to as everted-tip problem) in that an edge line 262*c* of the blade 262 is everted. In this regard, the thus everted tip has a restoring force, and therefore the tip tends to vibrate, resulting in generation of fluttering sounds.

In addition, when the cleaning operation is continued while the edge line 262*c* of the cleaning blade 262 is everted, a portion of the tip 262*a* of the cleaning blade 262, which is apart from the edge line 262*c* by few micrometers, is abraded as illustrated in FIG. 7B. When the cleaning blade 262 is further used for the cleaning operation, the portion of the tip 262*a* of the blade 262 is further abraded, resulting in lack of the edge line 262*c* of the blade 262 as illustrated in FIG. 7C. The cleaning blade 262 having no edge line cannot remove residual toner from the surface of the image bearer 23, thereby forming an abnormal image in which background thereof is soiled with residual toner.

A coating in which a fluorine compound monomer including a vinyl or an acryloyl group is mixed in an acrylic coating has attracted attention as a hard coat coating recently. When an acrylic coating in which a fluorine compound monomer is mixed is coated, the fluorine compound monomer is not uniformly present in an acrylic liquid and tends to be present in an air-liquid interface. After the acrylic coating is coated on an object, an UV light is irradiated to the coating such that the fluorine compound monomer is chemically bonded with an acrylic monomer of the acrylic coating at the outermost surface to noticeably decrease a frictional resistance of the surface of the object.

Because of these reasons, a need exists for a cleaner having high-durability and good cleanability.

SUMMARY

Accordingly, one object of the present invention is to provide a cleaner having high-durability and good cleanability.

Another object of the present invention is to provide an image forming apparatus using the cleaner.

These objects and other objects of the present invention, either individually or collectively, have been satisfied by the discovery of a cleaner, including a rectangle elastic blade to contact a surface-moving object in a counter direction to remove an extraneous matter adhering to the surface of the object. An apical surface of the elastic blade in a longitudinal direction includes a fluorine atom in an amount not less than 16.3% by atom when measured by X-ray photoelectron spectroscopy.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

The present invention provides a cleaner having high-durability and good cleanability.

An embodiment of the image forming apparatus of the present invention is explained by reference to drawings.

Figure 2:
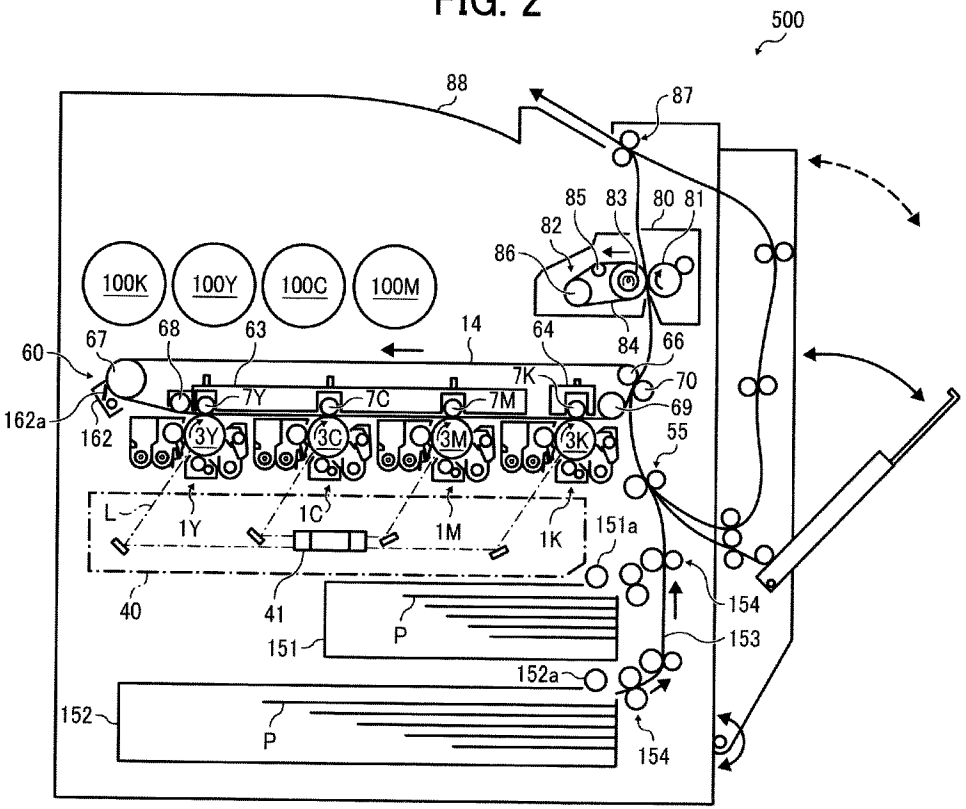
FIG. 2 is a schematic cross-sectional view illustrating an embodiment of the image forming apparatus of the present invention.

FIG. 2 illustrates an electrophotographic printer 500 as embodiment of the image forming apparatus of the present invention. The printer 500 includes four image forming units, i.e., yellow (Y), cyan (C), magenta (M) and black (K) image forming units 1Y, 1C, 1M and 1K. The four image forming units 1Y, 1C, 1M and 1K have the same configuration except that the color of toner used for developing an electrostatic latent image on a photoreceptor is different.

The printer 500 further includes a transfer unit 60, which includes an intermediate transfer belt 14 and which is located above the four image forming units 1. As mentioned later in detail, Y, C, M and K toner images formed on respective photoreceptors 3Y, 3C, 3M and 3K serving as photoreceptors are transferred onto the surface of the intermediate transfer belt 14 so as to be overlaid, resulting in formation of a combined color toner image on the intermediate transfer belt 14.

In addition, an optical writing unit 40 serving as a latent image former is located below the four image forming units 1. The optical writing unit 40 emits light beams L (such as laser beams) based on Y, C, M and K image information to irradiate the photoreceptors 3Y, 3C, 3M and 3K with the laser beams L, thereby forming electrostatic latent images, which respectively correspond to the Y, C, M and K images to be formed, on the photoreceptors. The optical writing unit 40 includes a polygon mirror 41, which is rotated by a motor and which reflects the light beams L emitted by a light source of the optical writing unit while deflecting the laser beams to irradiate the photoreceptors 3Y, 3C, 3M and 3K with the laser beams L via optical lenses and mirrors. The optical writing unit 40 is not limited thereto, and an optical writing unit using a LED array or the like can also be used therefor.

Below the optical writing unit 40, a first sheet cassette 151, and a second sheet cassette 152 are arranged so that the first sheet cassette is located above the second sheet cassette. Each of the sheet cassettes 151 and 152 contains a stack of paper sheets P serving as a recording material. Uppermost sheets of the paper sheets P in the first and second sheet cassettes 151 and 152 are contacted with a first feed roller 151*a* and a second feed roller 152*a*, respectively. When the first feed roller 151*a* is rotated (counterclockwise in FIG. 2) by a driver (not shown), the uppermost sheet P in the first sheet cassette 151 is fed by the first feed roller 151*a* toward a sheet passage 153 located on the right side of the printer 500 while extending vertically. Similarly, when the second feed roller 152*a* is rotated (counterclockwise in FIG. 2) by a driver (not shown), the uppermost sheet P in the second sheet cassette 152 is fed by the second feed roller 152*a* toward the sheet passage 153.

Plural pairs of feed rollers 154 are arranged in the sheet passage 153. The paper sheet P fed into the sheet passage 153 is fed from the lower side of the sheet passage 153 to the upper side thereof while being pinched by the pairs of feed rollers 154.

A pair of registration rollers 55 are arranged on the downstream side of the sheet passage 153 relative to the sheet feeding direction. When the pair of registration rollers 55 pinches the tip of the paper sheet P thus fed by the pairs of feed rollers 154, the pair of registration rollers 55 is stopped once, and is then rotated again to timely feed the paper sheet P to a secondary transfer nip mentioned below so that a combined color toner image on the intermediate transfer belt 14 is transferred onto the predetermined position of the paper sheet P.

Figure 3:
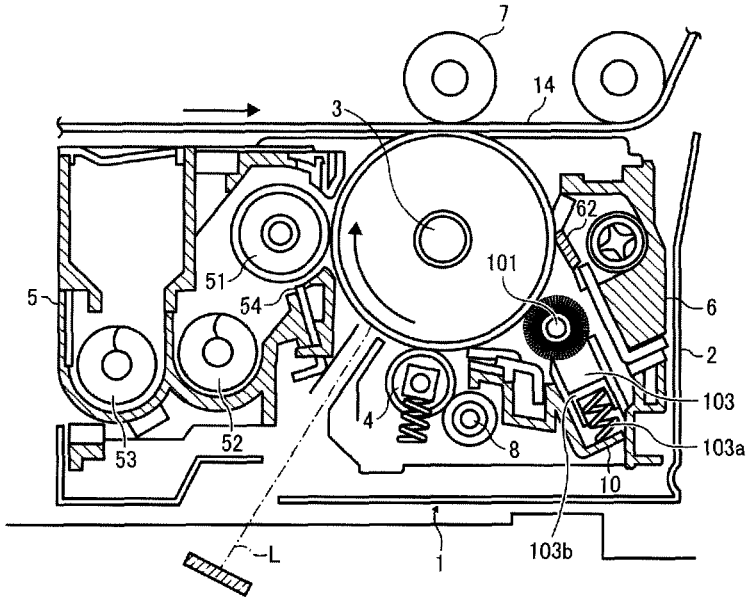
FIG. 3 is a schematic cross-sectional view illustrating an image forming unit of the image forming apparatus.

FIG. 3 illustrates one of the four image forming units 1.

As illustrated in FIG. 3, the image forming unit 1 includes a drum-shaped photoreceptor 3 serving as a photoreceptor. The shape of the photoreceptor 3 is not limited thereto, and sheet-shaped photoreceptors, endless belt-shaped photoreceptors and the like can also be used.

Around the photoreceptor 3, a charger 4, an image developer 5, a primary transfer roller 7, a cleaner 6, a lubricant applicator 10, a discharging lamp (not shown), etc., are arranged.

The charger 4 is arranged in the vicinity of the photoreceptor 3 with a predetermined gap therebetween, and evenly charges the photoreceptor 3 so that the photoreceptor 3 has a predetermined potential with a predetermined polarity. The thus evenly charged surface of the photoreceptor 3 is irradiated with the light beam L emitted by the optical writing unit 40 based on image information, thereby forming an electrostatic latent image on the surface of the photoreceptor 3.

The image developer 5 has a developing roller 51 serving as a developer bearing member. A development bias is applied to the developing roller 51 by a power source (not shown). A supplying screw 52 and an agitating screw 53 are provided in a casing of the image developer 5 to feed the developer in opposite directions in the casing so that the developer is charged so as to have a charge with a predetermined polarity. In addition, a doctor 54 is provided in the image developer to form a developer layer having a predetermined thickness on the surface of the developing roller 51. The layer of the developer, which has been charged so as to have a charge with the predetermined polarity, is adhered to an electrostatic latent image on the photoreceptor 3 at a development region, in which the developing roller 51 is opposed to the photoreceptor 3, resulting in formation of a toner image on the surface of the photoreceptor 3.

The cleaner 6 includes a fur brush 101, the cleaning blade 62, etc. The cleaning blade 62 is contacted with the surface of the photoreceptor 3 in such a manner as to counter the rotated photoreceptor 3. The cleaning blade 62 is mentioned later in detail.

The lubricant applicator 10 includes a solid lubricant 103, and a pressing spring 103*a* to press the solid lubricant 103 toward the fur brush 101 serving as a lubricant applicator to apply the lubricant to the surface of the photoreceptor 3. The solid lubricant 103 is supported by a bracket 1036 while being pressed toward the fur brush 101 by the pressing spring 103*a*. The solid lubricant 103 is scraped by the fur brush 101, which is driven by the photoreceptor 3 so as to rotate (counterclockwise in FIG. 5), thereby applying the lubricant 103 to the surface of the photoreceptor 3. By thus applying the lubricant, the friction coefficient of the surface of the photoreceptor 3 can be controlled so as to be not higher than 0.2.

Although the non-contact short-range charger 4 is used as the charger of the image forming unit 1, the charger is not limited thereto, and contact chargers (such as contact charging rollers), corotrons, scorotrons, solid state chargers, and the like can also be used for the charger.

Among these chargers, contact chargers, and non-contact short-range chargers are preferable because of having advantages such that the charging efficiency is high, the amount of ozone generated in a charging operation is small, and the charger can be miniaturized.

Specific examples of light sources for use in the optical writing unit 40 and the discharging lamp include any known light emitters such as fluorescent lamps, tungsten lamps, halogen lamps, mercury lamps, sodium lamps, light emitting diodes (LEDs), laser diodes (LDs), electroluminescent lamps (ELs), and the like.

In order to irradiate the photoreceptor 3 with light having a wavelength in a desired range, sharp cut filters, bandpass filters, infrared cut filers, dichroic filters, interference filters, color temperature converting filters, and the like can be used.

Among these light sources, LEDs and LDs are preferably used because of having advantages such that the irradiation energy is high, and light having a relatively long wavelength of from 600 to 800 nm can be emitted.

Next, the image forming operation of the printer 500 is explained.

Upon receipt of a print execution signal from an operating portion (not shown) such as an operation panel, predetermined voltages or currents are applied to the charging roller 4 and the developing roller 51 at predetermined times. Similarly, predetermined voltages or currents are applied to the light sources of the optical writing unit 40 and the discharging lamp. In synchronization with these operations, the photoreceptors 3 are rotated in a direction indicated by an arrow by a driving motor (not shown).

When the photoreceptors 3 are rotated, the surfaces thereof are charged by the respective charging rollers 4 so as to have predetermined potentials. Next, light beams L (such as laser beams) emitted by the optical writing unit 40 irradiate the charged surfaces of the photoreceptors 3, thereby forming electrostatic latent images on the surface of the photoreceptors 3.

The surfaces of the photoreceptors 3 bearing the electrostatic latent images are rubbed by magnetic brushes of the respective developers formed on the respective developing rollers 51. In this case, the (negatively-charged) toners on the developing rollers 51 are moved toward the electrostatic latent images by the development biases applied to the developing rollers 51, resulting in formation of color toner images on the surface of the photoreceptors 3Y, 3C, 3M and 3K. Thus, each of the electrostatic latent images formed on the photoreceptors 3 is subjected to a reverse development treatment using a negative toner. In this example, an N/P (negative/positive: a toner adheres to a place having lower potential) developing method using a non-contact charging roller is used, but the developing method is not limited thereto.

The color toner images formed on the surfaces of the photoreceptors 3Y, 3C, 3M and 3K are primarily transferred to the intermediate transfer belt 14 so as to be overlaid, thereby forming a combined color toner image on the intermediate transfer belt 14.

The combined color toner image thus formed on the intermediate transfer belt 14 is transferred onto a predetermined portion of the paper sheet P, which is fed from the first or second cassette 151 or 152 and which is timely fed to the secondary transfer nip by the pair of registration rollers 55 after being pinched thereby. After the paper sheet P bearing the combined color toner image thereon is separated from the intermediate transfer belt 14, the paper sheet P is fed to the fixing unit 80. When the paper sheet P bearing the combined color toner image thereon passes the fixing unit 80, the combined toner image is fixed to the paper sheet P upon application of heat and pressure thereto. The paper sheet P bearing the fixed combined color toner image (i.e., a full color image) thereon is discharged from the main body of the printer 500, resulting in stacking on the surface of the stacking portion 88.

Toners remaining on the surface of the intermediate transfer belt 14 even after the combined color toner image thereon is transferred to the paper sheet P are removed therefrom by the belt cleaning unit 162.

Toners remaining on the surfaces of the photoreceptors 3 even after the color toner images thereon is transferred to the intermediate transfer belt 14 are removed therefrom by the cleaner 6. Further, the surfaces of the photoreceptors 3 are coated with a lubricant by the lubricant applicator 10, followed by a discharging treatment using a discharging lamp.

As illustrated in FIG. 2, the photoreceptor 3, the charging roller 4, the developing device 5, the cleaner 6, the lubricant applicator 10, and the like are contained in a case 2 of the image forming unit 1 of the printer 500. The image forming unit 10 is detachable attachable to the main body of the printer 500 as a single unit (i.e., process cartridge). However, the image forming unit 1 is not limited thereto, and may have a configuration such that each of the members and devices such as the photoreceptor 3, charging roller 4, developing device 5, cleaner 6, and lubricant applicator 10 is replaced with a new member or device.

Next, the toner for use in the printer 500 (i.e., the image forming apparatus of the present invention) will be described.

The toner is preferably a toner having a high circularity and a small particle diameter. Such a toner can be preferably prepared by polymerization methods such as suspension polymerization methods, emulsion polymerization methods, dispersion polymerization methods, and the like. The toner preferably has an average circularity not less than 0.97, and a volume-average particle diameter not greater than 5.5 μm to produce high resolution toner images.

The average circularity of the toner is measured using a flow particle image analyzer FPIA-2000 from Sysmex Corp. The procedure is as follows:

(1) initially, 100 to 150 ml of water, from which solid foreign materials have been removed, 0.1 to 0.5 ml of a surfactant (e.g., alkylbenzenesulfonate) and 0.1 to 0.5 g of a sample (i.e., toner) are mixed to prepare a dispersion;

(2) the dispersion is further subjected to a supersonic dispersion treatment for 1 to 3 minutes using a supersonic dispersion machine to prepare a dispersion including particles at a concentration of from 3,000 to 10,000 pieces/μl;

(3) the dispersion set in the analyzer so as to be passed through a detection area formed on a plate in the analyzer; and (4) the particles of the sample passing through the detection area are optically detected by a CCD camera and then the shapes of the toner particles and the distribution of the shapes are analyzed with an image analyzer to determine the average circularity of the sample.

Figure 4A:
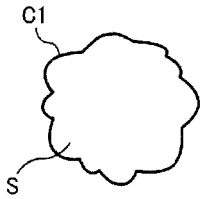
FIGS. 4A and 4B are schematic views for explaining a way to determine a circularity of a toner.
Figure 4B:
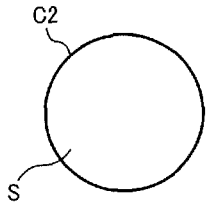

The method for determining the circularity of a particle will be described by reference to FIGS. 4A and 4B. When the projected image of a particle has a peripheral length C1 and an area S as illustrated in FIG. 4A, and the peripheral length of the circle having the same area S is C2 as illustrated in FIG. 4B, the circularity of the particle is obtained by the following equation.

$$\text{Circularity}=C2/C1$$

The average circularity of the toner is obtained by averaging circularities of particles.

The volume-average particle diameter of toner can be measured, for example, by an instrument such as COULTER MULTISIZER 2e manufactured by Beckman Coulter Inc. Specifically, the number-based particle diameter distribution data and the volume-based particle diameter distribution data are sent to a personal computer via an interface manufactured by Nikkaki Bios Co., Ltd. to be analyzed. The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl;
(2) 2 to 20 mg of a sample (toner) to be measured is added into the mixture;
(3) the mixture is subjected to an ultrasonic dispersion treatment for about 1 to 3 minutes; and
(4) the dispersion is added to 100 to 200 ml of an aqueous solution of an electrolyte in a beaker so that the mixture includes the particles at a predetermined concentration;
(5) the diluted dispersion is set in the instrument to measure particle diameters of 50,000 particles using an aperture of 100 μm to determine the volume average particle diameter.

In this regard, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 to 40.30 μm are targeted.

In this regard, the volume average particle diameter is obtained by the following equation.

$$\text{Volume average particle diameter}=\Sigma XfV/\Sigma fV,$$

wherein X represent the representative particle diameter of each channel, V represents the volume of the particle having the representative particle diameter, and f represents the number of particles having particle diameters in the channel.

Figure 1:
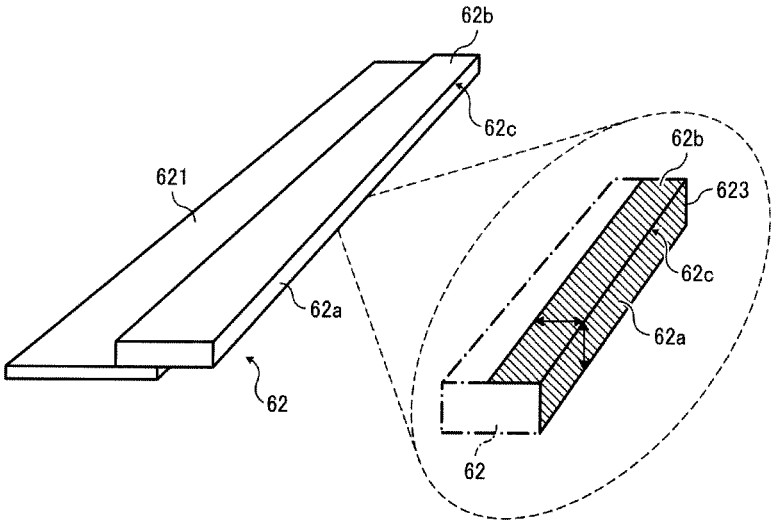
FIG. 1 is a schematic perspective view illustrating an embodiment of the cleaning blade of the present invention.
Figure 5:
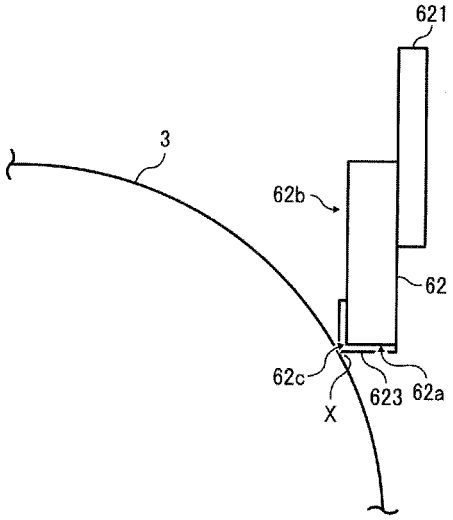
FIG. 5 is a schematic view illustrating an amplified cross-section of an embodiment of the cleaning blade of the present invention.

The elastic blade forming the cleaning blade 62 used in the embodiment of the cleaner 6 can be prepared by known methods using known compositions. FIG. 1 is a schematic perspective view illustrating the cleaning blade 62 and FIG. 5 is a schematic view illustrating an amplified cross-section thereof.

The cleaning blade 62 is formed of a rectangle elastic blade, and has a cut surface 62*a* as an apical surface which is an end surface of the cleaning blade in a longitudinal direction and an under surface 62*b* facing the surface of a photoreceptor. A surface layer 623 is formed so as to cover all of the cut surface 62*a* and an edge line 62*c* of the under surface 62*b*.

The elastic blade 62 is fixed to an upper end portion of a rectangle holder 621 formed of a rigid material such as metals and hard plastics, for example, by an adhesive. The other end of the holder 621 is cantilevered by a case the cleaner 6. In order that the elastic blade 62 can be satisfactorily contacted with the surface of the photoreceptor 3 even if the photoreceptor 3 is eccentric or the surface thereof is waved, the elastic blade 62 preferably has a high resilience coefficient. Rubbers having a urethane group such as urethane rubbers are preferably used therefor.

Polyurethane elastomer is typically formed by preparing a prepolymer using polyethyleneadipate ester or polycaprolactone ester as a polyol component and 4,4'-diphenylmethanediisocyanate, adding a hardener and an optional catalyst thereto to crosslink in a predetermined mold, and leaving and aging the crosslinked at room temperature.

Specific examples of high-molecular-weight polyol include polyester polyol which is a condensation product of alkylene glycol and aliphatic dibasic acid; polyester polyol of alkylene glycol and adipic acid such as ethylene adipate ester polyol, butylene adipate ester polyol, hexylene adipate ester polyol, ethylene propylene adipate ester polyol, ethylene butylene adipate ester polyol and ethylene neopentyl adipate ester polyol; polycaprolactone polyol such as polycaprolactone ester polyol obtained from ring-opening polymerization of caprolactone; and polyether polyol such as poly(oxytetramethylene)glycol and poly(oxypropylene)glycol.

Specific examples of low-molecular-weight polyol include diol such as 1,4-butanediol, ethyleneglycol, neopentylglycol, hydroquinone-bis(2-hydroxyethyl)ether, 3,3'-dichloro-4,4'-diaminophenylmethane and 4,4'-diaminodiphenylmethane; and tri- or more polyol such as 1,1,1-trimethylolpropane, glycerin, 1,2,6-hexanetriol, 1,2,4-butantriol, trimethylolethane, 1,1,1-tris(hydroxy ethoxymethyl)propane, diglycerin and pentaerythritol.

Specific examples of the hardening catalyst include 2-methylimidazole and 1,2-dimethylimidazole, and 1,2-dimethylimidazole is preferably used. The catalyst is preferably used in an amount of from 0.01 to 0.5 parts by weight, and more preferably from 0.05 to 0.3 parts by weight per 100 parts by weight of the main agent.

Japanese published unexamined application No. JP-2005-107376-A discloses a cleaning blade formed of polyurethane elastomer, in which isocyanate is layered on a part contacting a photoreceptor to have a thickness of 0.1 mm such that the cleaning blade has a longer life. The cleaning blade has good performance on an inorganic photoreceptor formed of amorphous silicon. However, the edge thereof contacting a photoreceptor is abraded earlier, resulting in defective cleaning in many cases when the photoreceptor is an organic photoreceptor including a surface layer in which inorganic particles are used, Japanese Patent No. JP-3602898-B1 (Japanese published unexamined application No. JP-H09-127846-A) discloses a cleaning blade formed of polyurethane elastomer in which a part contacting a photoreceptor is impregnated with acrylic urethane monomer and cured with UV light. The cleaning blade has no problem in cleanability at the beginning, but the part contacting a photoreceptor is abraded after images are repeatedly produced, resulting in defective cleaning in many cases.

The hardness of acrylic urethane monomer cannot be measured while impregnated in polyurethane elastomer. Therefore, acrylic urethane monomer is coated on a glass plate and irradiated with UV light to harden. The hardened film has sufficient hardness. However, the hardness of the urethane elastomer impregnated with acrylic urethane monomer and irradiated with UV light is far lower than expected. The hardness is occasionally almost same as that of the urethane elastomer itself and even lower than that.

The cleaning blade impregnated with acrylic urethane monomer has higher hardness and an end thereof is not deformed. Therefore, a pressure on the end is substantially high. Polymerized acrylic urethane has high friction resistance and the end contacting a photoreceptor is likely to be abraded.

Japanese published unexamined application No. JP-2000-66555-A discloses an image forming apparatus having a cleaning blade including a low friction layer to decrease frictional force between a photoreceptor and the cleaning blade. The cleaning blade has no problem in cleanability at the beginning. However, while images are repeatedly produced, low friction imparting materials are released from the low friction layer. A frictional force between a photoreceptor and the cleaning blade becomes high and the cleaning blade is partially abraded, resulting in defective cleaning.

Recently, a coating in which a fluorine compound monomer containing a vinyl group or an acryloyl group disclosed in Japanese published unexamined application No. JP-2005-15753 is mixed in an acrylic coating has attracted attention as a hard coat coating. The fluorine compound monomer containing a vinyl group or an acryloyl group is not uniformly present in the acrylic coating but in an air-liquid interface. When irradiated with UV light, the fluorine compound monomer containing a vinyl group or an acryloyl group is chemically bonded with an acrylic monomer of the acrylic coating to largely decrease friction resistance of the coated subject.

The present inventor dipped an elastic blade in an acrylic impregnating fluid in which the fluorine compound monomer is mixed and irradiated UV light thereto to prepare a modified cleaning blade, and found that the cleaning blade has high durability and good cleanability when an apical surface of the elastic blade in a longitudinal direction includes a fluorine atom in a specific range of amount when measured by X-ray photoelectron spectroscopy (XPS).

The present inventors dipped a cleaning blade in an acrylic impregnation liquid mixed with the fluorine compound monomer containing a vinyl group or an acryloyl group and irradiated UV light to the dipped cleaning blade. The surface of the cleaning blade decreased in friction resistance in many cases. However, unevenness was large and even the cleaning blade having low friction resistance soon increased therein while used, resulting in poor cleanability and abrasion.

The cleaning blade having a thick coated film soon increased in friction resistance. The hard acrylic resin could not endure deformation of the substrate and had a microscopic crack, resulting in abrasion.

The cleaning blade not having decreased in friction resistance included almost no fluorine materials at the surface.

Next, the present inventors sprayed an acrylic coating liquid mixed with the fluorine compound monomer containing a vinyl group or an acryloyl group onto a cleaning blade and irradiated UV light to the coated cleaning blade. It was possible to decrease friction resistance of the surface of the cleaning blade when coated with the liquid in a large amount. However, the cleaning blade soon increased in friction resistance while used, resulting in poor cleanability. The cleaning blade increased in friction resistance sooner than when impregnated with an acrylic coating.

When the end of the cleaning blade is frictionized with pressure, the acrylic resin layer is peeled off from the blade and microscopic cracks are easily formed. The acrylic monomer is no chemically bonded with a urethane substrate. An acrylic resin layer simply layered on the surface of the cleaning blade cannot follow deformation of a urethane rubber, resulting in peeling and microscopic cracks.

The present inventors tried to find a way of decreasing friction resistance while increasing hardness of the surface of the cleaning blade.

A fluorine compound is essentially used to decrease friction resistance of the surface of the cleaning blade. The fluorine compound is present only at the outermost surface and reacted with an acrylic monomer to be fixed on an acrylic resin layer.

When the acrylic resin layer is thick, it is easily cracked. When the acrylic resin layer is too thin to cover the surface of the cleaning blade, the blade is not expected to decrease in friction resistance with a fluorine compound. The cleaning blade is previously impregnated with an acrylic monomer and an acrylic coating liquid mixed with the fluorine compound monomer containing a vinyl group or an acryloyl group is coated in a small amount on the blade to be polymerized. Thus, a polymer of the acrylic compound impregnated in the cleaning blade is combined with the substrate urethane rubber. Therefore, the polymer of the acrylic compound is not peeled from the urethane rubber and chemically bonded with the fluorine compound monomer at the surface of the cleaning blade. The acrylic resin layer is so thin that the acrylic resin layer itself is not cracked and is not peeled because of being chemically bonded with the impregnated acrylic polymer.

In this embodiment, the cut surface 62*a* of the cleaning blade 62 is subjected to XPS (X-ray photoelectron spectroscopy) to measure the content of fluorine atom. The content thereof is not less than 16.3%, preferably not less than 18%, and more preferably from 20 to 50% by atom.

When the content is in this range, the friction resistance between the cleaning blade 62 and the photoreceptor 3 can largely be reduced. Therefore, the cleaning blade 62 largely improves in durability while maintaining good cleanability.

The element analysis by XPS only measures elements in a depth of 5 nm from the surface. Therefore, the content not less than 16.3% and preferably not less than 18% means a fluorine compound is surely present at the surface of the cleaning blade.

The fluorine component at the surface of the cleaning blade 62 is not easily removed even when frictionized, and the cleaning blade 62 has the following properties. An aluminum drum having the same shape of the photoreceptor 3 is installed in the printer. After the aluminum drum and the cleaning blade 62 are frictionized each other for 1 min, the cut surface 62*a* of the cleaning blade 62 is subjected to XPS. The content of the fluorine atom is not less than 16.3%, preferably not less than 18%, and more preferably not less than 19%, and furthermore preferably from 20 to 50% by atom.

Basically, the content of the fluorine atom in the cleaning blade 62 remains unchanged even after the photoreceptor 3 (aluminum drum) and the cleaning blade 62 are frictionized each other. However, the fluorine components are likely to line in a horizontal direction and the content tends to be slightly higher.

The aluminum drum instead of the photoreceptor 3 is used because silicon oil or organic components present on the surface of the photoreceptor are electrostatically attracted to the surface of the cleaning blade. XPS cannot detect the fluorine components under extraneous matters. The extraneous matters have low adherability and repeat releasing and adhering while the cleaning blade 62 is used. They do not influence on performance of the cleaning blade 62 but cause a large measurement error.

Even when the aluminum drum and the cleaning blade 62 are frictionized each other, components contaminating the cleaning blade 62 do not come from the aluminum drum. Therefore, only the fluorine components at the surface of the cleaning blade after frictionized can precisely be measured by XPS. Further, the cleaning blade 62 is mechanically deformed in the same way when the photoreceptor 3 is used, and variation of the fluorine components at the surface of the cleaning blade can precisely be measured.

When the cut surface 62*a* of the cleaning blade 62 is measured by XPS, A (a ratio of carbon atom % by weight) B (total of $CF_2$ bond ratio and $CF_3$ bond ratio in C1s spectrum)/100 is not less than 5%, and more preferably not less than 6% by atom.

—$CF_2$ and —$CF_3$ are groups effectively decreasing friction resistance of the surface of the cleaning blade. Particularly, the more —$CF_3$, the larger the effect of decreasing friction resistance. —$CF_3$ is preferably included two to three times as much as —$CF_2$ to effectively decrease friction resistance. Further, —$CF_3$ can easily prepare the fluorine compound monomer containing a vinyl group or an acryloyl group and has good solubility to an acrylic monomer.

The cleaning blade 62 is impregnated with an acrylate polymer in a depth of from 5 to 100 μm, preferably of from 8 to 80 μm, and more preferably from 10 to 70 μm. The acrylate polymer is indispensable to increase mechanical strength of the cleaning blade 62 and chemically fix the fluorine components at the surface of the blade.

When the depth is less than 5 Inn, the blade decreases in durability and the fluorine components at the surface of the cut surface 62*a* cannot be fixed thereon. The cleaning blade deteriorates rather than improves. When deeper than 100 μm, the depth is not uniform in a longitudinal direction of the cleaning blade 62. Therefore, the cleaning blade 62 has uneven mechanical properties and a part which has low mechanical property is likely to be abraded.

The cleaning blade 62 is impregnated in a solution including an acrylate monomer for a specific time. Then, it is essential that the cleaning blade 62 is fully dried. When the cleaning blade 62 is impregnated in a solution including an acrylate monomer, after the cleaning blade 62 is impregnated in a solution including an acrylate monomer under reduced pressure, the blade is impregnated under normal pressure or pressurized. Thus, the acrylate monomer impregnates in the cleaning blade 62 at high density.

After the cleaning blade 62 is impregnated in a solution including an acrylate monomer, the solution adhering to the surface of the cleaning blade is preferably wiped out by a waste or a removed by air knife because of being unnecessary.

When the acrylate monomer is impregnated in the cleaning blade, the solution need not include the fluorine compound monomer containing a vinyl group or an acryloyl group. This is because the fluorine compound monomer containing an acryloyl group is likely to be present in an air-liquid interface and difficult to enter the cleaning blade. The fluorine components do not decrease friction resistance until they are present on the surface of the cleaning blade, and has almost no effect when they are in the cleaning blade.

After the acrylate monomer is fully impregnated in the cleaning blade, an acrylate monomer solution including a fluorine compound monomer containing an acryloyl group is coated on the surface of the cleaning blade. The fluorine compound monomer present at the surface of the cleaning blade is preferably as little as possible so long as it is present at the surface thereof in a specific amount. As mentioned above, the fluorine compound monomer is likely to be present in the air-liquid interface.

The fluorine compound monomer is present at the surface of the cleaning blade if the solution does not excessively penetrate into the cleaning blade. Then, the fluorine compound monomer is chemically reacted with the acrylate monomer impregnated in the cleaning blade or chemically bonded therewith through the coated acrylic monomer. The acrylate monomer can be replaced with polyene/polythiol.

Then, an energy line such as UV light and electron beam is irradiated to polymerize the acrylate monomer and the acrylate monomer including a fluorine compound monomer containing an acryloyl group.

An oxygen density around the cleaning blade when the energy line is irradiated is not greater than 2%, and more preferably 1%. When higher than 2%, the acrylate monomer in the cleaning blade is unreacted or just becomes an oligomer. The cleaning blade decreases inner strength and is likely to be abraded.

The acrylate monomer and a solvent decreasing a viscosity of the acrylate monomer typically include dissolved oxygen. It is preferable that an inactive gas such as helium, argon and nitrogen is subjected to bubbling or evacuation is made to remove the dissolved oxygen.

The surface layer 623 typically includes an acrylic polymer and/or a polyene/polythiol resin containing a fluorine component at the outermost surface. The acrylic polymer is chemically bonded with the acrylic polymer in the cleaning blade and fixed.

The surface layer 623 has a thickness of from 0.01 to 1.00 μm, and preferably from 0.02 to 0.6 μm. When less than 0.01 μm, the surface layer is difficult to uniformly form, resulting in parts having no surface layer. When larger than 1.00 μm, the surface layer cannot endure deformation of the cleaning blade 62, resulting in microscopic cracks.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

<Base Elastic Blade of Cleaning Blade 62>

As an elastic blade forming the cleaning blade 62, an elastic blade formed of polyurethane and used in imagio mp C6001 from Ricoh Company, Ltd. was used.

<Impregnation of Acrylic Material in Elastic Blade>

An edge of the elastic blade was dipped in a coating liquid for 5 min. The elastic blade was drawn from the coating liquid, and the excessive coating liquid adhering to the surface of the elastic blade was wiped out with a water-absorbing sponge roller.

A surface layer 623 was formed on an edge contacting an object to be cleaned of the cleaning blade 62 by spray coating. PC-308WIDE from Olympos was used as a sprayer. From a position far from the surface of the edge by 35 mm, a discharge amount was controlled so as to form the layer having a specific thickness while a spray gun was moved at a pressure of 0.5 MPa and a speed of 7.5 mm/s. Then, the coated blade was left for 5 min and vacuum-dried at 30° C. for 10 min, and irradiated with UV light at 1,000 mJ/$cm^2$. All chemicals used in the spray coating liquid were frozen and subjected to vacuum dehydration to remove oxygen. The spray coating and drying were made in an environment in which oxygen density was 100 ppm.

| (Acrylate Material 1) | |
|---|---|
| Pentaerythritoltriacrylate | 80 |
| Dipentaerythritolhexaacrylate | 20 |
| IRGACURE 184 from Ciba Specialty Chemicals | 5 |
| 2-butanol | 60 |

| (Acrylate Material 2) | |
|---|---|
| Pentaerythritoltriacrylate | 80 |
| Dipentaerythritolhexaacrylate | 20 |
| IRGACURE 184 from Ciba Specialty Chemicals | 5 |
| DAIKIN OPTOOL DAC-HP | 1 |
| 2-butanol | 89 |

-continued

| (Acrylate Material 3) | |
|---|---|
| Pentaerythritoltriacrylate | 70 |
| Trimethylolpropanetriacrylate | 30 |
| IRGACURE 184 from Ciba Specialty Chemicals | 5 |
| 2-butanol | 60 |
| (Acrylate Material 4) | |
| Pentaerythritoltriacrylate | 70 |
| Trimethylolpropanetriacrylate | 30 |
| DAIKIN OPTOOL DAC-HP | 7 |
| IRGACURE 184 from Ciba Specialty Chemicals | 5 |
| 2-butanol | 60 |

The thus prepared cleaning blade 62 was installed in imagio mp C6001 from Ricoh Company, Ltd., which included an aluminum drum having the same shape as that of the photoreceptor 3. The cleaning blade 62 and the aluminum drum were frictionized with each other for 1 min.

The cut surfaces 62*a* of the cleaning blade 62 when prepared and the frictionized cleaning blade 62 were measured by XPS to determine a present ratio of the fluorine atom.

A 1,000 nm thick chip of the cleaning blade 62 when prepared was formed by Cryo-microtome, placed on a silicon wafer, and the thickness of the surface layer was measured by an optical microscope and SEM. From the edge of the cleaning blade 62 toward inside, impregnated depth of an acrylate polymer was measured by FT-IR. The impregnated depth of an acrylate polymer was evaluated by presence of an IR peak around 1,162 $cm^{-1}$ of the acrylate polymer. The thickness of the surface layer was evaluated by SEM.

Example 1

The acrylate material 1 was used to impregnate a base elastic blade of the cleaning blade and 62 and the acrylate material 2 was used as a coating liquid for the surface layer 623 to prepare a cleaning blade 62.

The surface layer 623 had a thickness of 0.06 μm and the acrylate polymer had an impregnated depth of 51 μm.

Example 2

The acrylate material 3 was used to impregnate a base elastic blade of the cleaning blade and 62 and the acrylate material 4 was used as a coating liquid for the surface layer 623 to prepare a cleaning blade 62.

The surface layer 623 had a thickness of 0.09 μm and the acrylate polymer had an impregnated depth of 43 μm.

Example 3

The procedure for preparation of the cleaning blade 62 in Example 2 was repeated except for coating the surface layer 623 twice.

The surface layer 623 had a thickness of 0.14 μm and the acrylate polymer had an impregnated depth of 40 μm.

Example 4

The procedure for preparation of the cleaning blade 62 in Example 2 was repeated except for coating the surface layer 623 five times.

The surface layer 623 had a thickness of 0.33 μm and the acrylate polymer had an impregnated depth of 41 μm.

Example 5

The procedure for preparation of the cleaning blade 62 in Example 2 was repeated except for coating the surface layer 623 ten times.

The surface layer 623 had a thickness of 0.98 μm and the acrylate polymer had an impregnated depth of 39 μm.

Example 6

The procedure for preparation of the cleaning blade 62 in Example 2 was repeated except that the base elastic blade of the cleaning blade 62 was placed in a glass container and depressurized inside to 10 mm Hg, the acrylate material 3 was placed therein and left for 25 sec, and then returned to normal pressure inside to impregnate the acrylate material into the elastic blade.

The surface layer 623 had a thickness of 0.07 μm and the acrylate polymer had an impregnated depth of 65 μm.

Example 7

The procedure for preparation of the cleaning blade 62 in Example 6 was repeated except for changing from 7 to 3 parts of DAIKIN OPTOOL DAC-HP in the acrylate material 4 for the surface layer 623.

The surface layer 623 had a thickness of 0.09 μm and the acrylate polymer had an impregnated depth of 70 μm.

Comparative Example 1

The procedure for preparation of the cleaning blade 62 in Example 3 was repeated except for not using DAIKIN OPTOOL DAC-HP in the acrylate material 4 for the surface layer 523 and coating the surface layer 623 eleven times.

The surface layer 623 had a thickness of 1.3 μm and the acrylate polymer had an impregnated depth of 40 μm.

Comparative Example 2

The procedure for preparation of the cleaning blade 62 in Comparative Example 1 was repeated except for using 0.3 parts of DAIKIN OPTOOL DAC-HP in the acrylate material 4 for the surface layer 623.

The surface layer 623 had a thickness of 1.4 μm and the acrylate polymer had an impregnated depth of 40 μm.

Next, each of the cleaning blades 62 of Examples 1 to 7 and Comparative Examples 1 and 2 was installed in MFP imagio mp C5000 from Ricoh Company, Ltd. A toner prepared by a polymerization method was used.

Mother toner had a circularity of 0.98 and an average particle diameter of 4.7 μm.

As external additives, 1.5 parts of silica having a small particle diameter H2000 from Clariant (Japan) K.K., 0.5 parts of titanium oxide MT-150AI from Tayca Corp., and 1.0 part of silica having a large particle diameter UFP-30H from DENKA DENKI KAGAKU KOGYO KABUSHIKI KAISHA were used.

On hundred thousand (100,000) images (A4) of a chart having an image area ratio of 5% were produced at 3 print/job, 21° C. and 65% RH.

[Evaluated Items]

Defective cleaning (Visual observation)

Figure 6:
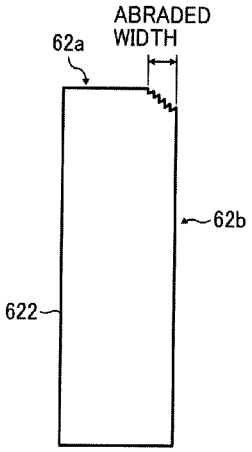
FIG. 6 is a schematic view for explaining a way to determine a width of an abraded portion of an elastic blade.
Figure 7A:
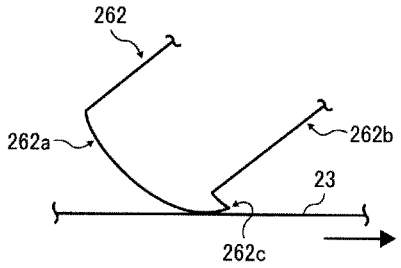
FIGS. 7A to 7C are schematic views for explaining how a cleaning blade is damaged.
Figure 7B:
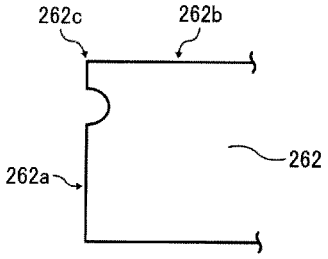
Figure 7C:
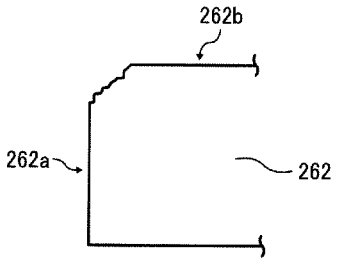

Evaluated images: 20 (A4) images of a chart including three vertical stripes having a width of 43 mm Blade edge abraded width and abraded form: seen from under surface of the cleaning blade 62 as FIG. 6 shows.

The results are shown in Tables 1-1 and 1-2.

TABLE 1-1

| | Surface Layer Thickness (μm) | Impregnation thickness (μm) | F when prepared (% by atom) | AB/100 when prepared (% by atom) |
|---|---|---|---|---|
| Example 1 | 0.06 | 51 | 16.3 | 5.4 |
| Example 2 | 0.09 | 43 | 30.8 | 10.3 |
| Example 3 | 0.14 | 40 | 31.4 | 10.5 |
| Example 4 | 0.33 | 41 | 31.6 | 10.5 |
| Example 5 | 0.98 | 39 | 31.4 | 10.5 |
| Example 6 | 0.07 | 65 | 33.1 | 11.0 |
| Example 7 | 0.09 | 70 | 20.9 | 7.0 |
| Comparative Example 1 | 1.3 | 40 | 0.0 | 0.0 |
| Comparative Example 2 | 1.4 | 40 | 15.2 | 4.9 |

TABLE 1-2

| | F after frictionized (% by atom) | Cleaning | Abraded width (μm) | Abraded form |
|---|---|---|---|---|
| Example 1 | 0.06 | Good | 15 | Abraded from edge |
| Example 2 | 0.09 | Excellent | 10 | Abraded from edge |
| Example 3 | 0.14 | Excellent | 10 | Abraded from edge |
| Example 4 | 0.33 | Excellent | 10 | Abraded from edge |
| Example 5 | 0.98 | Excellent | 10 | Abraded from edge |
| Example 6 | 0.07 | Excellent | 10 | Abraded from edge |
| Example 7 | 0.09 | Excellent | 10 | Abraded from edge |
| Comparative Example 1 | 1.3 | Poor | 35 | Everted |
| Comparative Example 2 | 1.4 | Poor | 25 | Everted |

In Table 1, Excellent means no defective cleaning. Good means defective cleaning having no problem in practical use. Poor means defective cleaning unacceptable in practical use. The thickness of the surface layer 523 was measured by a microscope VHX-100 from Keyence Corp. separately from a cross-section of an elastic blade 622 similarly coated. The elastic blade 622 was cut by a trimming razor for preparing an SEM sample from Nissin EM Corp.

As Table 1 shows, the cleaning blades 62 of Examples 1 to 7 have much better durability while keeping good cleanability than the cleaning blades 62 of Comparative Examples 1 to 2.

Having now fully described the invention, it will be apparent to one of ordinary skill in the art that many changes and modifications can be made thereto without departing from the spirit and scope of the invention as set forth therein.

What is claimed is:

1. A cleaner, comprising;

a rectangle elastic blade configured to contact a surface-moving object in a counter direction to remove an extraneous matter adhering to the surface of the object, wherein the elastic blade includes a surface layer comprising a copolymer of a fluorine compound comprising an acrylic compound and a vinyl group or an acryloyl group, wherein an apical surface of the elastic blade in a longitudinal direction comprises fluorine in an amount, in atomic composition percentage, not less than 16.3% when measured by X-ray photoelectron spectroscopy.

2. The cleaner of claim 1, wherein the apical surface of the elastic blade in a longitudinal direction comprises fluorine in an amount not less than 18% of the atomic composition when measured by X-ray photoelectron spectroscopy.

3. The cleaner of claim 1, wherein the apical surface of the elastic blade, when analyzed by X-ray photoelectron spectroscopy (XPS), satisfies a relational expression of (a):

$$A \times B/100 \geq 5 \quad \text{(a), where}$$

A [atomic %] is a ratio of C1s peak in XPS spectrum, and

B [atomic %] is sum of a ratio of CF2 peak area in C1s peak area and a ratio of CF3 peak area in C1s peak area.

4. The cleaner of claim 1, wherein the surface layer comprising a fluorine compound has a thickness in the range of 0.01 to 1.00 μm.

5. An image forming apparatus, comprising:

a charger configured to charge the surface of an image bearer;

a latent image former configured to form an electrostatic latent image on the charged image bearer;

an image developer configured to develop the electrostatic latent image with a toner to form a toner image; and the cleaner according to claim 1, configured to contact the surface of the image bearer to remove an extraneous matter adhering thereto.

6. The image forming apparatus of claim 5, wherein the apical surface of the elastic blade in a longitudinal direction comprises fluorine in an amount, in atomic composition percentage, not less than 18%, as measured by X-ray photoelectron spectroscopy after frictionizing an aluminum drum for 1 min, the aluminum drum having replaced the image bearer, which has the same shape of a drum as the image bearer.

* * * * *